US007959525B1

(12) United States Patent
Brown

(10) Patent No.: US 7,959,525 B1
(45) Date of Patent: Jun. 14, 2011

(54) DUAL COMPOSITION GOLF TEE

(76) Inventor: Louis S. Brown, Pensacola, FL (US)

( * ) Notice: Subject to any disclaimer, the term of this patent is extended or adjusted under 35 U.S.C. 154(b) by 0 days.

(21) Appl. No.: 13/023,628

(22) Filed: Feb. 9, 2011

(51) Int. Cl.
*A63B 69/36* (2006.01)

(52) U.S. Cl. ..... 473/387; 473/135

(58) Field of Classification Search ..... 473/387–403, 473/132–137
See application file for complete search history.

(56) References Cited

U.S. PATENT DOCUMENTS 4,741,537 A * 5/1988 Adam ..... 473/135
5,016,886 A * 5/1991 Gould ..... 473/135
5,085,431 A * 2/1992 McGuire ..... 473/398
5,282,629 A * 2/1994 Eckstein ..... 473/133
5,356,148 A * 10/1994 Elder, Jr. ..... 473/133
5,549,299 A * 8/1996 Brown ..... 473/133
5,643,096 A * 7/1997 Lowe ..... 473/135
5,645,491 A * 7/1997 Brown ..... 473/135
6,083,122 A * 7/2000 Brown ..... 473/401
6,120,383 A * 9/2000 Brown ..... 473/135
7,252,595 B2 * 8/2007 Regev ..... 473/135

* cited by examiner

*Primary Examiner* — Steven Wong
(74) *Attorney, Agent, or Firm* — Dennis G. LaPointe

(57) ABSTRACT

A dual composition polymeric device to be used as a golf tee, the device having a polymeric hollow stiff stem portion with an integral cone portion at its top end, a cone-shaped polymeric flexible face portion mechanically joined to the cone and stiff stem portion and an internal air passage through the center of the cone-shaped flexible face and a removable mechanical screw joining the cone-shaped flexible face portion with the stiff stem portion and its integral cone portion. The flexible face portion internal cone is made from a 50-85 durometer elastomer material and the stiff stem portion and its integral external cone is made from a 90-95 durometer elastomer material.

5 Claims, 3 Drawing Sheets

DUAL COMPOSITION GOLF TEE

FIELD OF THE INVENTION

The invention relates to a dual composition polymeric device to be used as a golf tee in air operated automatic teeing machines for repetitive striking of golf balls.

BACKGROUND OF THE INVENTION

One form of a dual composition tee is disclosed in U.S. Pat. No. 6,083,122 to Brown. The disclosed device includes a single fused tee where the stem portion is made from a 90-95 Shore A durometer elastomer material and the fused integral flared tee portion on which a golf ball sits is made from a 70-85 Shore A durometer elastomer material. One disadvantage of the Brown device in U.S. Pat. No. 6,083,122 is that the softer flexible portion may deteriorate after a few thousand strikes of a club head while the harder or stiffer device can last significantly longer.

The disclosure of U.S. Pat. No. 6,083,122 is herein incorporated by reference in its totality in lieu of repeating major relevant parts of the disclosure, including reference to typical patented automatic teeing machines referred to therein and the need to provide a superior vacuum seal and shear strength that allows for a smaller face diameter at the flared portion than the harder urethane tees, while providing resistance to abrasion and tearing from repeated golf club strikes.

SUMMARY OF THE INVENTION

The invention is a dual composition polymeric device to be used as a golf tee. The device is a three component device that includes a polymeric hollow stiff stem portion with an integral cone portion at its top end, a cone-shaped polymeric flexible face portion mechanically joined to the cone and stiff stem portion and an internal air passage through the center of the cone-shaped flexible face and a removable mechanical screw joining the cone-shaped flexible face portion with the stiff stem portion and its integral cone portion. The flexible face portion is made from a softer elastomer material, for example a 50-85 Shore A durometer polyurethane resin elastomer and the stiff stem portion and its integral flared cone is made from a harder material, for example a 90-95 Shore A durometer polyurethane resin elastomer. Other elastomeric materials may be used in a lieu of a polyurethane resin elastomer material.

A hollow mechanical joining barb coupling typically serves as quick-disconnect means to secure the golf tee assembly to a typical golf ball teeing machine. There are several methods of connecting the present invention to golf machines such as a push-connect air fitting or a miniature air quick-disconnect coupling or a threaded hollow fastener depending on the machine or the preferences of the user or the owner of the machine.

DETAILED DESCRIPTION OF THE INVENTION

Figure 1:
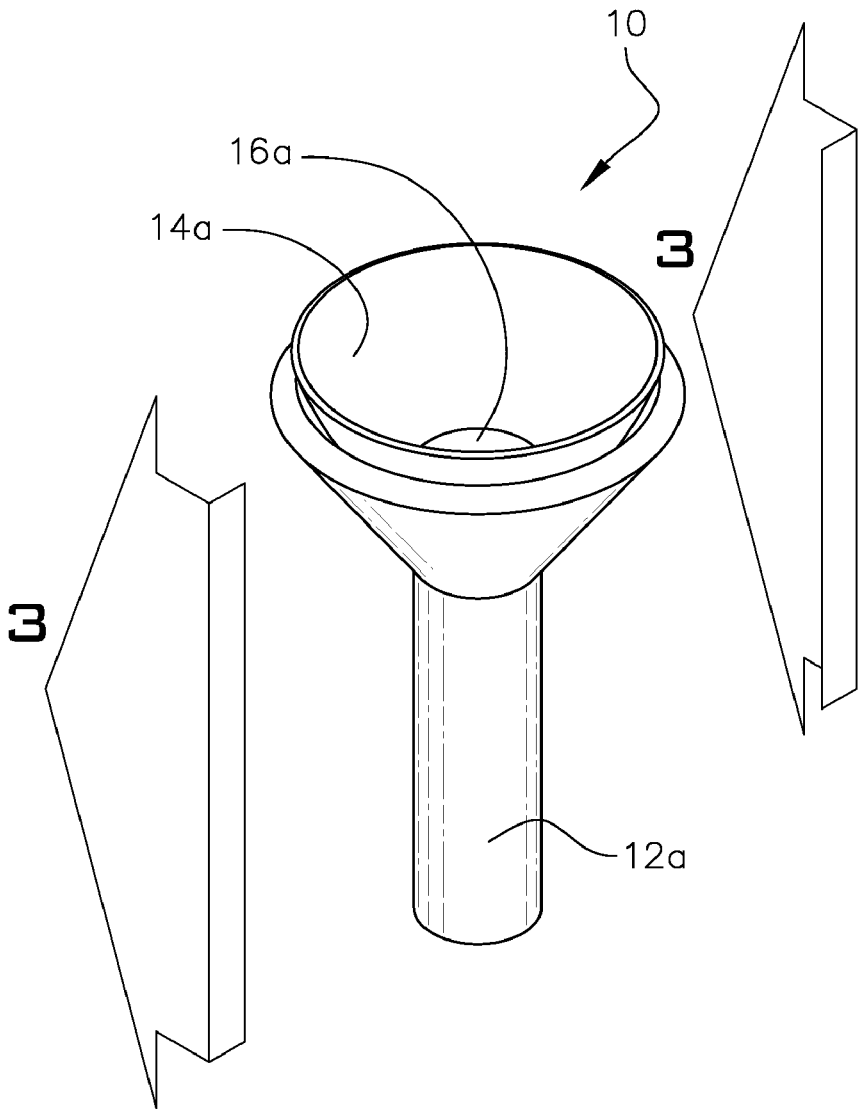
FIG. 1 is a representative conceptual depiction of the invention.
Figure 2:
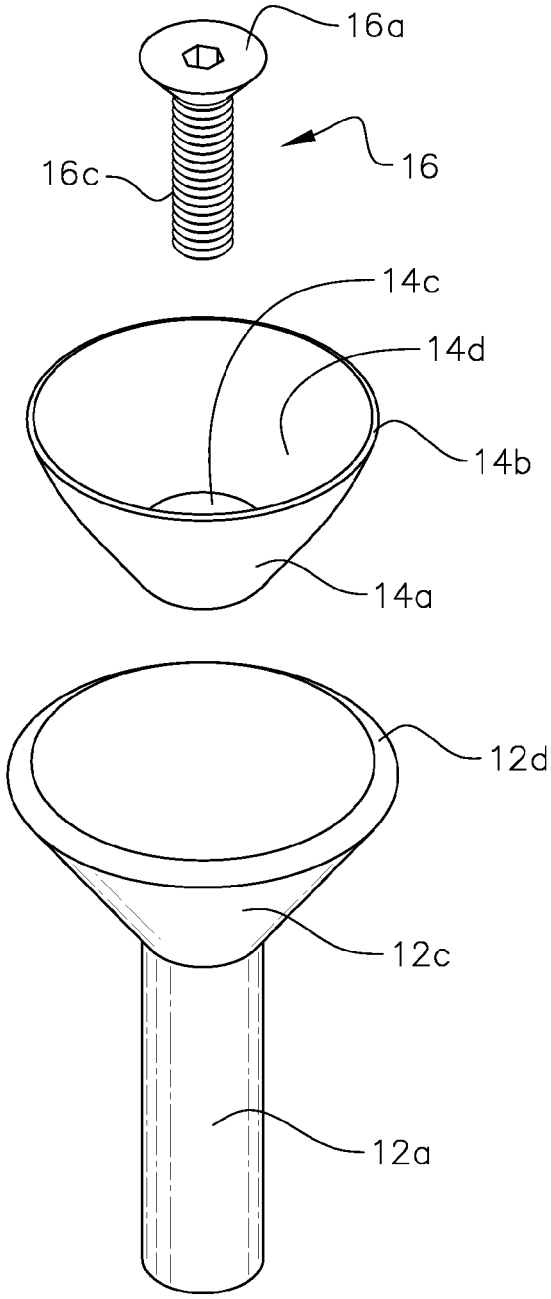
FIG. 2 is an exploded view of one example of typical components to form the present invention.

Referring now to the drawings, FIGS. 1-4 disclose a representative embodiment of the present invention, which is a dual composition device to be used as a golf tee and is depicted generally as 10.

The dual composition device 10 comprises a tubular-shaped stiff stem portion 12*a*, which is hollow 12*b* for the passage of air therein. The stem portion 12*a* further has at one end thereof a stiff cone-shaped portion 12*c* flared at a distal end 12*d* thereof. In a preferred embodiment, the stem portion 12*a* and its integral stiff cone-shaped portion 12*c* are made from a material such as a 90-95 Shore A polyurethane resin elastomer material or other tough elastomeric materials or compounds. It may be preferable for mass production to make the stem portion 12*a* separately from the cone portion 12*c* and then join them using a mechanical method such as a barb coupling similar to 16*c* when the softer cone 14*a* is joined to the stiffer cone 12*c*. The drawings FIGS. 3-4 do not show the stem 12*a* separate from the cone 12*c* but it is understood that they could be separate portions to form the combination stiffer cone/stem assembly.

The device 10 includes a second component which comprises a separate flexible face cone-shaped portion 14*a*, which is flared at a distal end 14*b* thereof. The separate flexible face portion 14*a* has an opening 14*c* at a bottom thereof for the insertion of the third component of the invention, which is means 16 for mechanically joining the separate flexible face cone-shaped portion 14*a* in a concentric relationship with the stiff cone-shaped portion 12*c*. The means 16 includes an air passage way 16*b* therein axially aligned with the hollow stem portion 12*b*. The separate flexible face portion 14*a* is preferably made from a softer material such as a 50-85 Shore A durometer polyurethane resin elastomer material. Although the preferred embodiment may be to use a softer material such as 70-85 Shore A durometer polyurethane resin elastomer material, it is understood that the durometer of the softer material could be as low as a 50 durometer material or other tough elastomeric materials may be used.

When attached to an automatic teeing machine air system, the separate flexible face portion 14*a* produces a vacuum seal on a golf ball (not shown) when a suction from a vacuum source (not shown) is applied through the stiff stem portion 12*a* and the means 16 for mechanically joining the separate flexible face cone-shaped portion 14*a* in the joined concentric relationship with the stiff cone-shaped portion 12*c*.

There are several ways known in the art to join the cones 14*a* concentrically within cone 12*c* to stem 12*a*. One example is in the form of a chemical or heat fusion such as that described in U.S. Pat. No. 6,083,122 to Brown. But the preferred means is a mechanical method that would allow for the replacement of the softer flexible cone portion 14*a*, while continuing the use of the stiffer stem portion 12*a* and its cone 12*c*. Barbed couplings could be used and screw type fasteners as long as they are hollow devices. It is preferred that a joining device be used that is easily removed to replace the flexible cone 14*a* when needed, yet provide no interference within the cone 14*a* volume for the golf ball to be sealed. One example of a preferred device that accomplishes this objective is a mechanical one such as a hollow flat head screw 16*a* sized and configured to compress and hold a bottom end 14*c* of the separate flexible face portion 14*a* against a bottom end 12*e* of the stiff cone-shaped portion 12*c*. The flat head screw 16*a* may be provided externally with a barbed or threaded stem

16*c*, preferably threaded stem 16*c*, which is sized and configured to frictionally engage an inside surface 12*f* of the stiff stem portion 12*a* such that when a golf club is struck against a side of the dual composition tee 10, the screw 16*a* will not disengage from the inside surface 12*f* of the stiff stem portion 12*a*. The tapered underside of the flat head screw effectively compresses against the bottom 14*c* of the flexible cone portion 14*a* and squeezes the cone portion 14*a* against the bottom 12*e* of the stiffer cone 12*c* as the screw is inserted and engaged with the inside surface 12*f* of the stiff stem 12*b*. This compression action seals the cones to avoid or minimize vacuum loss between the cones.

Figure 3:
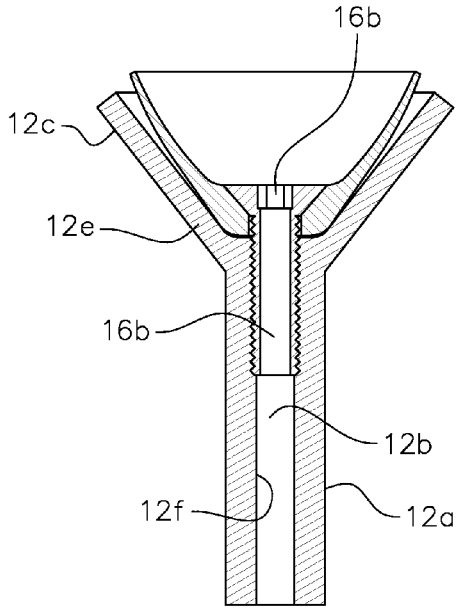
FIG. 3 is a cross-section view of the invention assembled depicting the flexible cone slightly higher in height than the stiffer cone.
Figure 4:
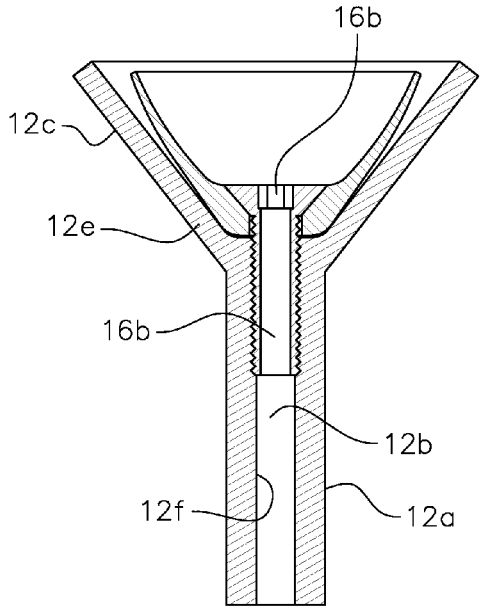
FIG. 4 is a view similar to FIG. 3 except that the stiffer outer cone is slightly higher than the inner softer cone.

Ideally, is it desired that the ball when sealed against cone 14*a* at its flared end 14*b*, there should be no interference with the vacuum seal caused by the flared end 12*d* of the stiff cone 12*c*. Accordingly, flared distal end 14*b* of the separate flexible face portion 14*a* should be configured to be a predetermined distance higher, that is, slightly higher, than the flared distal end 12*d* of the stiff cone-shaped portion 12*c* when joined to the stiff cone-shaped portion 12*c*. However, to maximize protection of the softer cone, the stiffer cone could be made to form a larger diameter cone with or without a height higher or equal to that of the softer cone. FIGS. 3-4 show alternative higher or lower embodiments but it is understood that the heights could be equal.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. A dual composition device to be used as a golf tee comprising:

a tubular-shaped stiff stem portion, said stiff stem portion being hollow for the passage of air therein, a stiff cone-shaped portion flared at a distal end thereof, said stiff cone-shaped portion being formed integrally with said stem portion or made to be connected with said stem portion;

a separate flexible face cone-shaped portion, said flexible face portion being flared at a distal end thereof; and said separate flexible face cone-shaped portion having an opening at a bottom thereof for the insertion of means for joining said separate flexible face cone-shaped portion in a concentric relationship with said stiff cone-shaped portion, wherein said means includes an air passage way therein axially aligned with said hollow stem portion, wherein the separate flexible face portion produces a vacuum seal on a golf ball when a suction from a vacuum source is applied through the stiff stem portion and the means for mechanically joining said separate flexible face cone-shaped portion in said concentric relationship with said stiff cone-shaped portion, and wherein said stiff cone-shaped portion serves to protect said flexible face cone-shaped portion when said golf ball is struck by a golf club.

2. The device according to claim 1, wherein the means for joining said separate flexible face cone-shaped portion in said concentric relationship with said stiff cone-shaped portion comprises:

a hollow flat head screw sized and configured to compress and hold a bottom end of said separate flexible face portion against a bottom end of said stiff cone-shaped portion, said flat head screw having external threads sized and configured to frictionally engage an inside surface of the stiff stem portion such that when said golf club is struck against a side of the device the screw will not disengage from said inside surface of said stiff stem portion.

3. The device according to claim 1, wherein said flared distal end of said separate flexible face portion is configured to be a predetermined distance higher, equal to, or lower than said flared distal end of said stiff cone-shaped portion when joined to said stiff cone-shaped portion.

4. The device according to claim 1, wherein said separate flexible face portion is made from a elastomeric material, the elastomeric material being 50-85 Shore A durometer.

5. The device according to claim 1, wherein said stem portion and its flared stiff cone-shaped portion both being made from a 90-95 Shore A elastomeric material.

* * * * *